US012564760B2

(12) United States Patent
Reed et al.

(10) Patent No.: US 12,564,760 B2
(45) **Date of Patent: *Mar. 3, 2026**

(54) STAIR STEP EXERCISE MACHINE

(71) Applicant: Stronger Brands Consulting, LLC, McKees Rocks, PA (US)

(72) Inventors: Shawn Reed, McKees Rocks, PA (US); David Weckerly, Knox, PA (US); Charles Kennedy, Moon Township, PA (US)

(73) Assignee: Stronger Brands Consulting, LLC, McKees Rocks, PA (US)

( * ) Notice: Subject to any disclaimer, the term of this patent is extended or adjusted under 35 U.S.C. 154(b) by 128 days.

This patent is subject to a terminal disclaimer.

(21) Appl. No.: 18/532,623

(22) Filed: Dec. 7, 2023

(65) Prior Publication Data

US 2024/0359052 A1 Oct. 31, 2024

Related U.S. Application Data

(63) Continuation of application No. 17/352,914, filed on Jun. 21, 2021, now Pat. No. 11,872,444.

(60) Provisional application No. 63/045,269, filed on Jun. 29, 2020.

(51) Int. Cl.

| | |
|---|---|
| ***A63B 22/04*** | (2006.01) |
| ***A63B 21/00*** | (2006.01) |
| ***A63B 21/005*** | (2006.01) |
| ***A63B 21/06*** | (2006.01) |
| ***A63B 21/22*** | (2006.01) |
| ***A63B 24/00*** | (2006.01) |
| *A63B 71/06* | (2006.01) |

(52) U.S. Cl.

CPC ..... *A63B 22/04* (2013.01); *A63B 21/0056* (2013.01); *A63B 21/154* (2013.01); *A63B 21/225* (2013.01); *A63B 21/4035* (2015.10); *A63B 24/0087* (2013.01); *A63B 2071/0658* (2013.01)

(58) Field of Classification Search

CPC ..... A63B 22/04; A63B 21/225

See application file for complete search history.

(56) References Cited

U.S. PATENT DOCUMENTS

| | | | | |
|---|---|---|---|---|
| 3,592,466 A * | 7/1971 | Parsons | A63B 22/04 482/53 |
| 4,687,195 A * | 8/1987 | Potts | A63B 22/04 482/52 |
| 4,927,136 A * | 5/1990 | Leask | A63B 22/04 482/52 |
| 5,328,420 A | 7/1994 | Allen | |
| 5,556,352 A | 9/1996 | Chang | |

(Continued)

FOREIGN PATENT DOCUMENTS

| | | | |
|---|---|---|---|
| CN | 102728025 A * | 10/2012 | |
| KR | 102141008 B1 * | 8/2020 | A63B 21/0056 |

*Primary Examiner* — Joshua T Kennedy

(74) *Attorney, Agent, or Firm* — Fish & Richardson P.C.

(57) ABSTRACT

A manual stair step exerciser that simulates the exercise derived from climbing stairs including a support frame with a chain sprocket assembly having multiple equal spaced deployable steps thereon. A drive shaft pulley and belt assembly interconnects to an adjustable magnetic resistant flywheel for sustained user step input of kinetic energy for sustaining self-propelled tread induced motion during exercise.

17 Claims, 7 Drawing Sheets

(56) References Cited

U.S. PATENT DOCUMENTS

| | | | | |
|---|---|---|---|---|
| 5,769,759 | A | 6/1998 | Alter et al. | |
| 9,789,355 | B1 * | 10/2017 | Lo | A63B 22/04 |
| 12,350,547 | B2 * | 7/2025 | Dalebout | A63B 22/04 |
| 2012/0264572 | A1 * | 10/2012 | Fenster | A63B 21/0051 482/52 |
| 2017/0246500 | A1 * | 8/2017 | Gatti | A63B 22/04 |
| 2017/0304674 | A1 * | 10/2017 | Johnson | A63B 22/04 |
| 2021/0402251 | A1 * | 12/2021 | Reed | A63B 24/0087 |

* cited by examiner

STAIR STEP EXERCISE MACHINE

CROSS-REFERENCE TO RELATED APPLICATION

This application is a continuation of U.S. application Ser. No. 17/352,914, filed on Jun. 21, 2021, which claims the benefit of U.S. Provisional Application No. 63/045,269 filed on Jun. 29, 2020. The entire contents of these provisional applications are herein incorporated by reference.

BACKGROUND

Exercise can require physical activity to enhance or maintain fitness and overall health.

TECHNICAL FIELD

This device relates to exercise machines, more specifically to stair step devices that provide indoor exercisers to simulate climbing stairs to strengthen and tone muscles and impart cardio benefits to the exerciser.

DESCRIPTION OF PRIOR ART

Prior art devices of this type are inclusive of a variety of room exercise machines to specifically exercise the legs such as exercise cycles and stair step devices. Such stair step devices are generally configured as either powered or manual wherein the user essentially drives steps by the physical input. Examples of such can be seen in U.S. Pat. Nos. 3,592,466, 4,687,195, 4,927,136, 5,328,420, 5,556,352 and 5,769,759.

U.S. Pat. No. 3,592,466 discloses a revolving step exerciser with adjustable step and fluid drive pump.

U.S. Pat. No. 4,687,195 claims a treadmill exerciser having a tread and riser step portion and an endless chain with a gyroscopic flywheel and braking device interconnected therewith.

U.S. Pat. No. 4,927,136 describes and claims a braking system for a step exercise device having a magnetic brake with electromagnetic controlled torque for complete electronic control.

U.S. Pat. No. 5,328,420 shows a stair step machine having an adjustable angle for step linkage assembly.

U.S. Pat. No. 5,556,352 illustrates a stair exerciser having a plurality of revolvable steps on an endless chain with a control device by weight and action of the user on the steps.

Finally, in U.S. Pat. No. 5,769,759 a stair climbing apparatus is disclosed with selection input of step height and angle according to user's preference.

SUMMARY

A manual stair step exercise device providing a moving user driven step drive chain for continuous step climbing simulated in a self-contained compact frame device. A flywheel with magnetic resistance is in communication with the step drive train providing induced user motion for user adjustable resistance having a no friction resistance control for smooth variable step control for defining desired step cadence per minute.

The details of one or more embodiments of the subject matter of this specification are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

Figure 1:
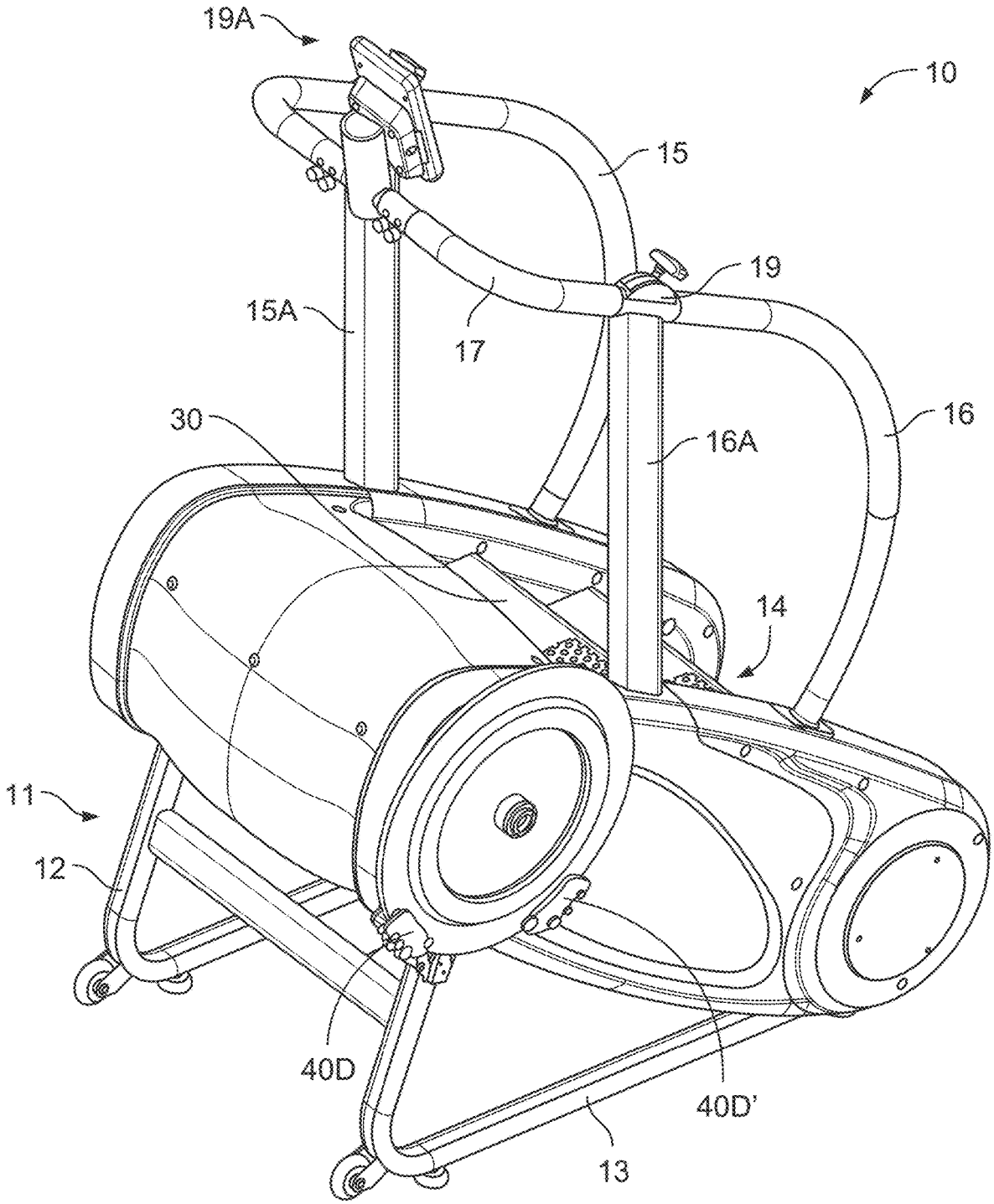
FIG. 1 is a front and side perspective view of the step exercise device of the invention.
Figure 2:
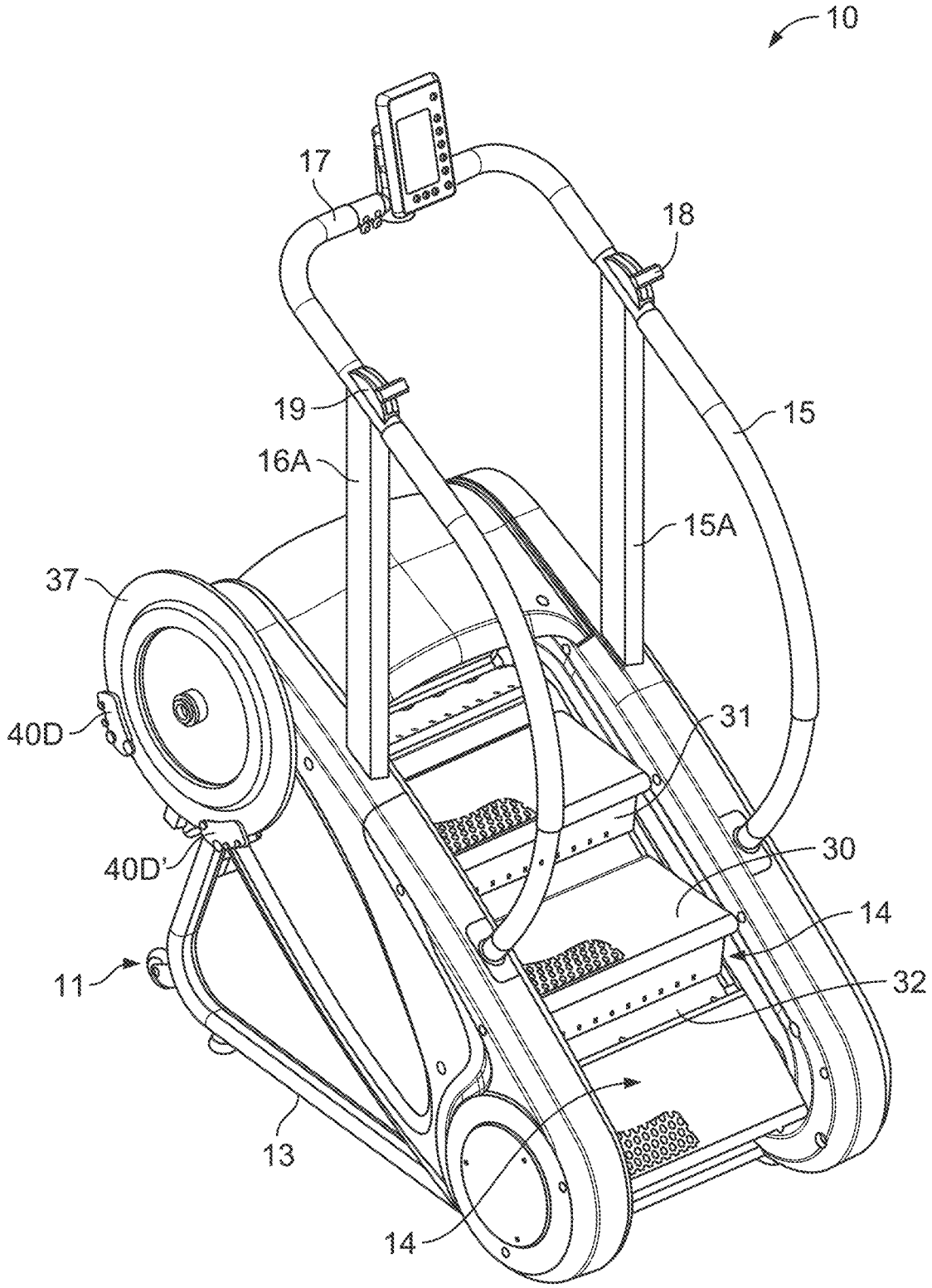
FIG. 2 is a rear, top and side perspective view thereof.
Figure 4:
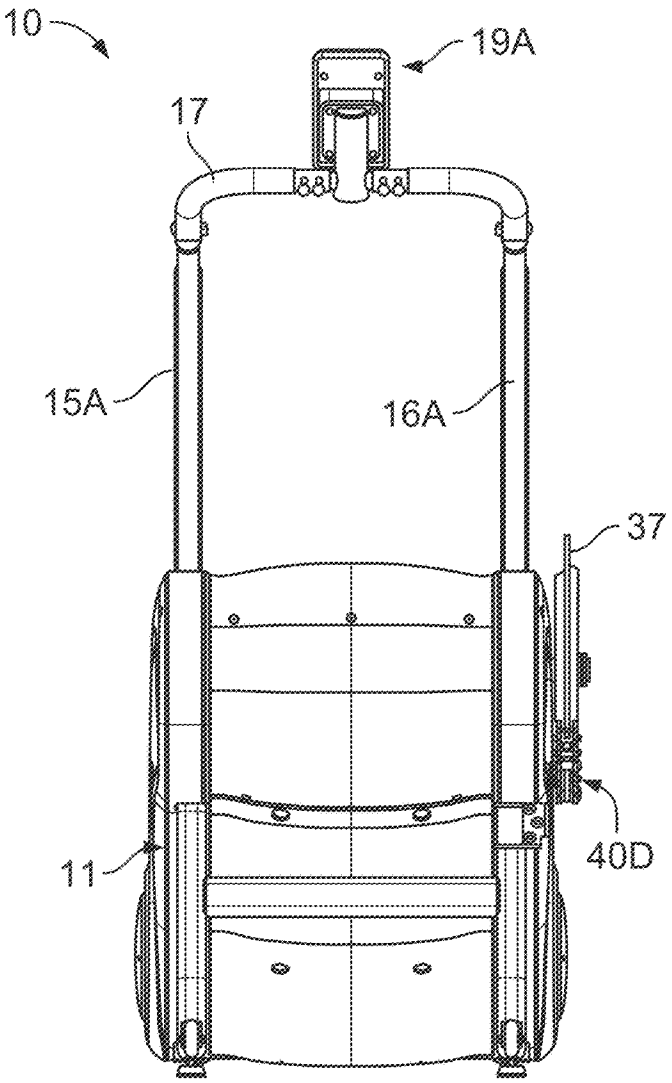
FIG. 4 is a front elevational view thereof.
Figure 3:
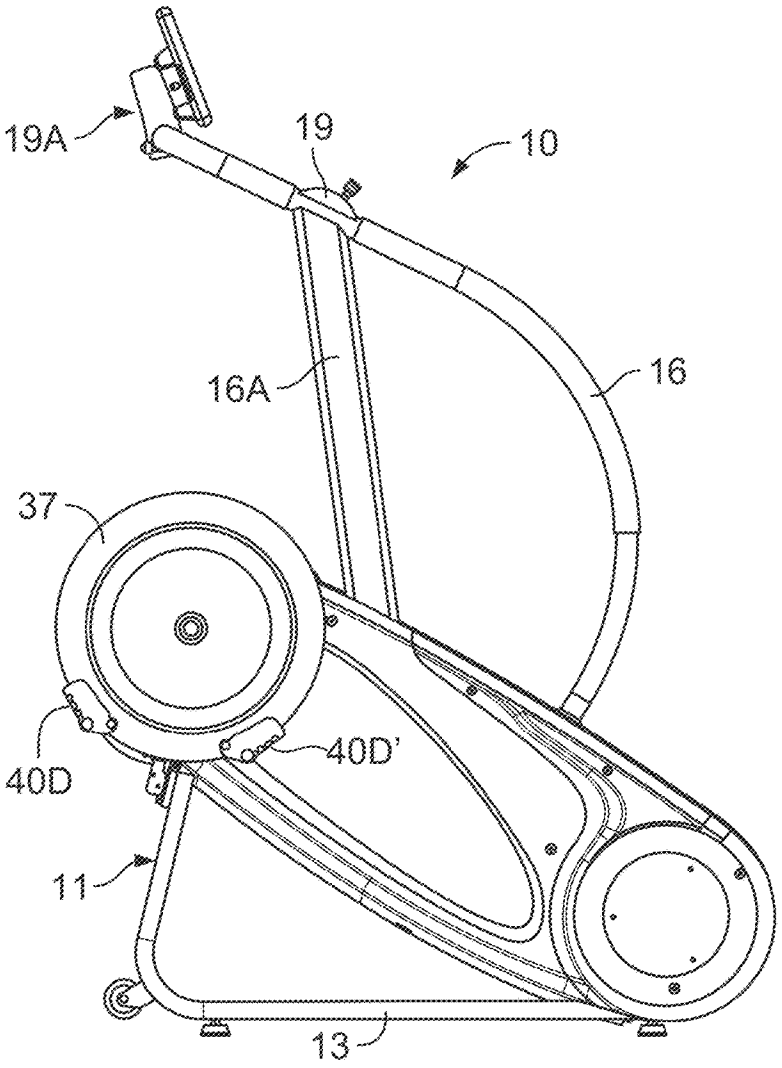
FIG. 3 is a side elevational view of the step exercise device of the invention.

Referring to FIGS. 1-4 of the drawings, a stair step exercise device 10 of the invention can be seen having a main support frame 11 defined by a pair of spaced parallel tubular L-shaped support legs 12 and 13 with an endless step assembly 14 supported there between. A pair of upstanding tubular handrail members 15 and 16 extend respectively therefrom with an interconnecting cross support rail portion 17. Each of the hand rail members 15 and 16 have an angular post support 15A and 16A extending therefrom to the main frame 11 defining a pair of sturdy hand engagement surfaces with a pair of resistance control input levers 18 and 19 for user weight input and desired resistant levels respectively, as will be described in greater detail hereinafter.

The tubular cross support rail 17 provides a central mounting position for an upstanding electronic informational controller and input display screen 19A. As noted, the endless step assembly 14 is supported within and between the respective main frame leg support members 12 and 13 in an angular inclination orientation, best seen in FIG. 2 of the drawings.

Figure 5:
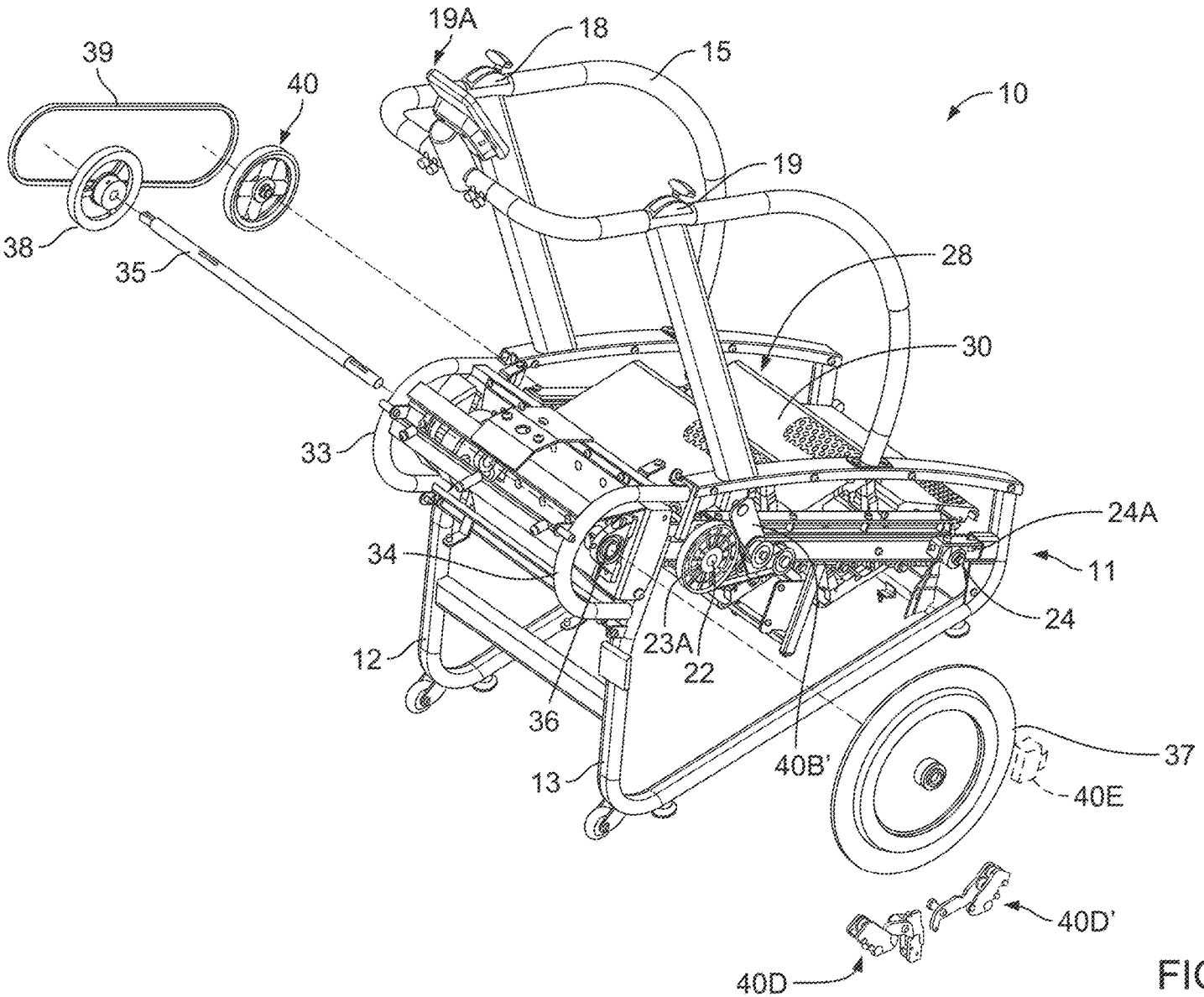
FIG. 5 is a front, top and side partial perspective exploded view of the step exercise device with portions broken away for visual clarity.
Figure 6:
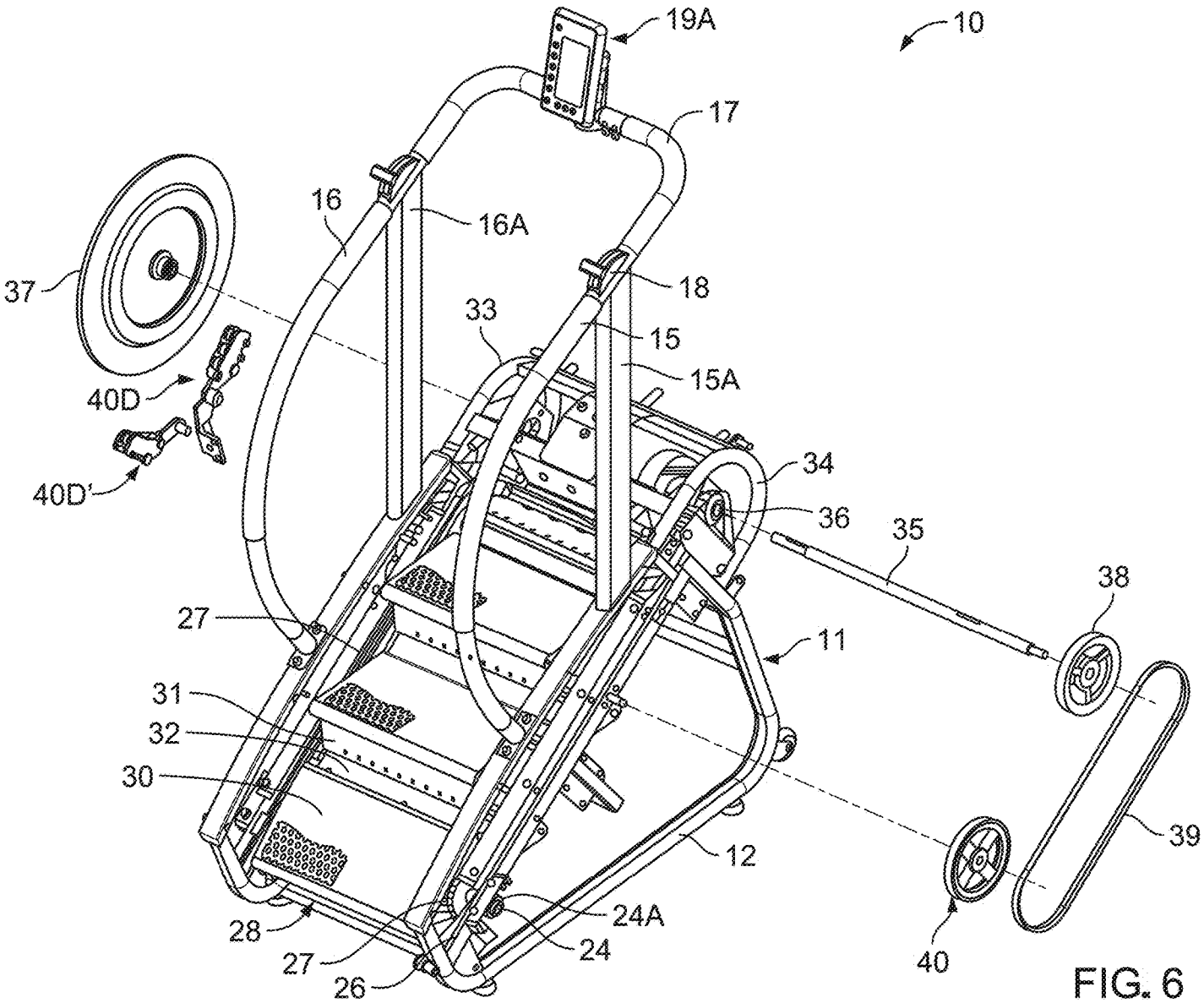
FIG. 6 is a rear, top and side perspective exploded view of the step exercise device of the invention with portions broken away.
Figure 8:
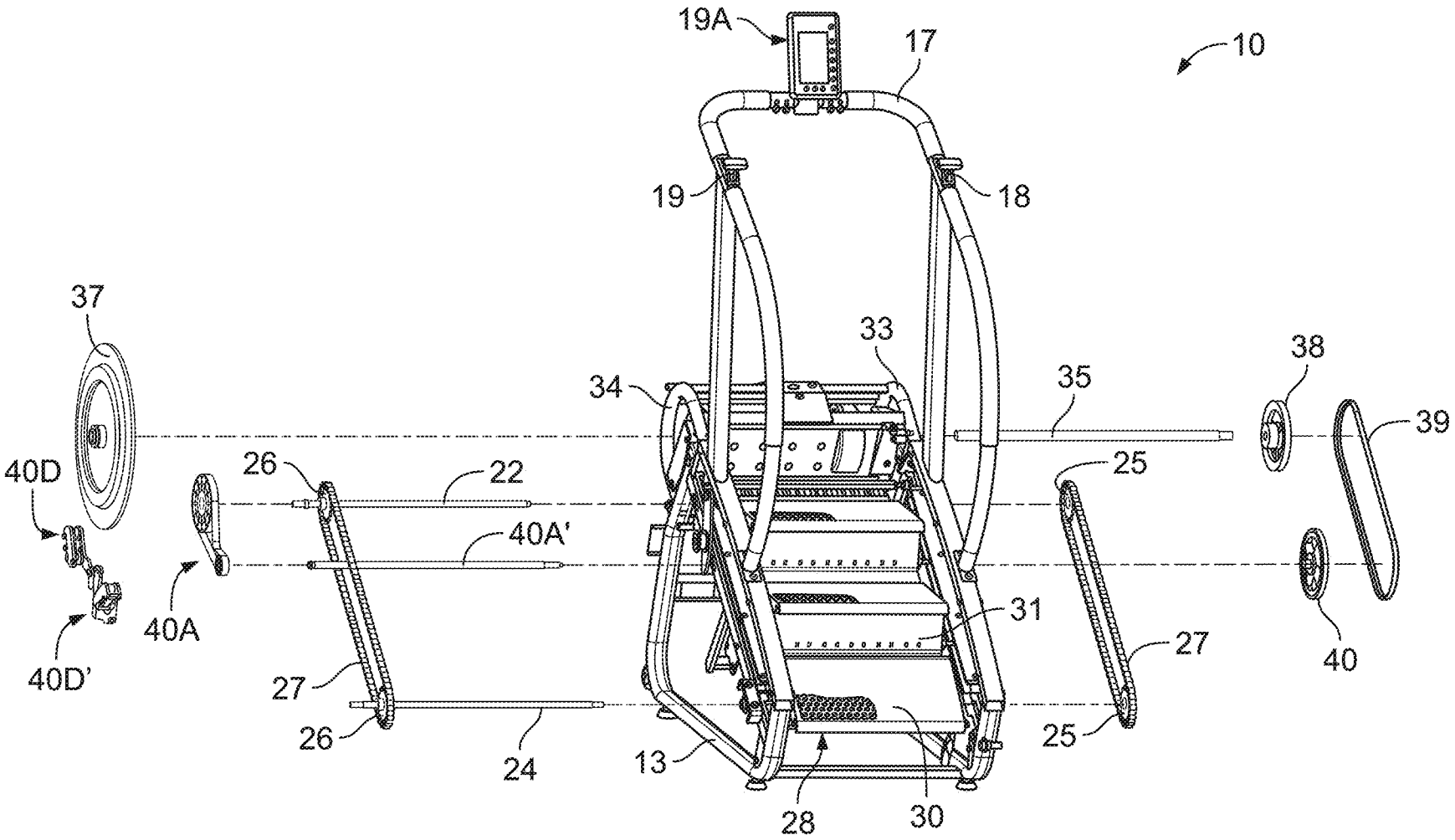
FIG. 8 is an exploded perspective view of the primary form of the invention.

Referring now to FIGS. 5, 6 and 8 of the drawings, the step drive assembly 14 includes upper drive shaft 22, rotatably supported on end shaft support bearing sets 23A and a lower drive shaft 24 supported by respective end shaft support bearings 24A as understood by those skilled in the art.

Pairs of chain engagement sockets 25 and 26 are mounted on the respective drive shafts 22 and 24. Endless chains 27 extend around the respective upper and lower sprocket pairs 25 and 26 interlinking same. The plurality of equal spaced movable step assemblies 28 are disposed between and interengaged by the respective chains 27. Each of the step assemblies 28 comprises a tread 30 and a riser 31 with an interconnecting plate 32 there between. The tread 30 and riser 31 are hinged to provide a continuous moving step engagement surface for the user, not shown, to simulate climbing a set of fixed stairs. Such movable inclined step assemblies achieve an endless step configuration for the user by essentially folding each stair step for return to the upper drive shaft 22's position.

The main support tubular frame has a pair of upper end U-shaped extensions of 33 and 34 that extend in spaced parallel relation about a flywheel drive shaft 35 and bearing assembly 36. The flywheel drive shaft 35 has a weighted flywheel 37 secure to one end and a drive pulley 38 to its oppositely disposed end. The drive pulley 38 is in turn connected by a drive belt 39 to a stair chain engagement pulley 40 in communication with a dual pulley and belt assembly 40A via a shaft 40A' which engages the upper drive shaft 22. A belt engagement tension 40B' pivots from the stair frame to maintain flywheel sprocket engagement, as understood in the art, best seen in FIGS. 5 and 8 of the drawings.

The flywheel 37 has a set of electromagnetic resistant brake assemblies 40D and 40D' that will impart independent adjustable magnetic induced resistance to the flywheel 37 by varying the magnetics' positional relationship to the flywheel 37. Such magnetic induced resistance is well known in the art to achieve an adjustable frictionless drag on a flywheel by increasing or reducing rotational resistance coupled with the inherent gyroscopic rotation of the weighted flywheel in such environments. The selective engagement of the brake assembly 40D and 40D' pairs provide imparted control as to user, not shown, weight and step speed via variances thereof by control input levers 18 and 19 respectively.

It should be noted, that an optional safety mechanical brake 40E may also be incorporated into the flywheel design dependent on the manufacturing requirements as indicated by broken lines in FIG. 5 of the drawings for illustration only.

Figure 7:
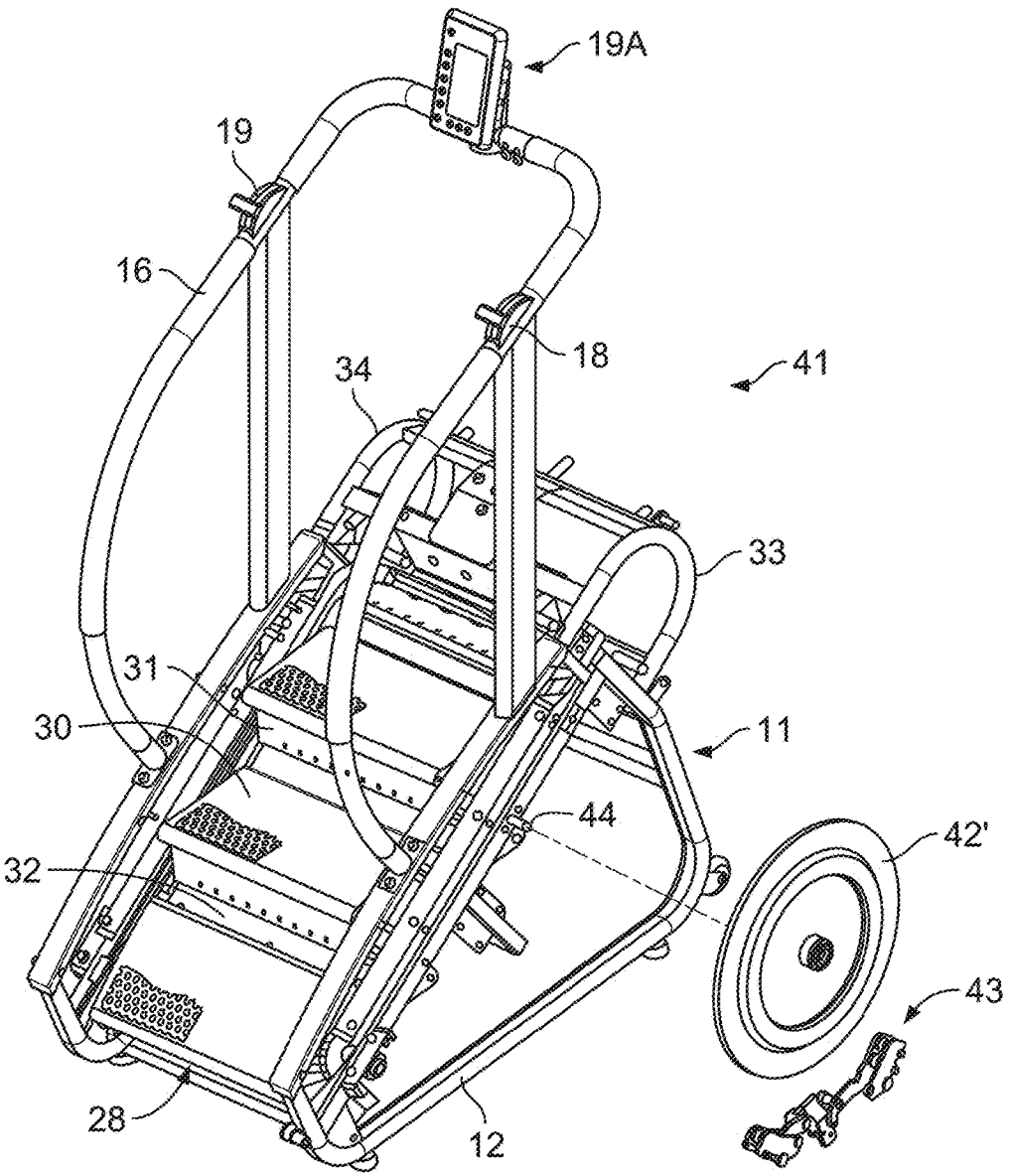
FIG. 7 is a front, top and side partial exploded perspective view of an alternate flywheel positioning on a stair exercise device.

Referring now to FIG. 7 of the drawings, an alternate form of the invention 41 can be seen having essentially the same frame and endless step assembly disclosed in the primary form of the invention hereinbefore with a relocation of a kinetic energy flywheel 42'. In this example, the kinetic energy flywheel 42' with its magnetic induction resistant brake assembly 43 is repositioned onto a stair chain engagement drive engagement shaft 44 of a pulley assembly as hereinbefore described in the primary form midway on the stair step assembly. This direct engagement to the endless step assembly provides for a more compact footprint and eliminates the reduction rotation ratio that is achieved additionally by the multiple pulley and belt assembly 40A and engagement flywheel assembly, the primary form of the invention as disclosed above.

It will be seen that the manual stair step device 10 of the invention utilizing a stepping engagement configuration of a moving step drive train on an integrated welded tubular frame 11. As noted, the main advantage of such a unit is that it requires no electricity to be driven and functional. The stair step exercise devices 10 and 41 with their magnetic resistant flywheels 37 and 42' induces a simulation of perpetual motion which allows the unit to be "self-propelled" like and balanced with the user's body weight. Such magnetic resistance flywheel induced operational configurations provides for the advantage of reduced friction effectively making for a consistent and smooth operational performance which is variable from very light to heavy resistance controllable by user's input via the control levers 18 and 19, noted above.

It will thus be seen that a new and novel stair step exercise device 10 of the invention has been illustrated and described having a resistant adjustment endless stair step assembly with a magnetic adjustment resistant flywheel to maintain optimum steps per minute emulating prior art motorized units.

As such, the user level resistant controls provided and combined with an input control display parameters for calculating specific workout limits based on user's desired exercise level can be achieved. It will therefore be seen that various changes and modifications may be made therein without departing from the spirit of the invention.

What is claimed is:

1. A stair step device comprising:

a frame having a pair of spaced legs;

an upper drive shaft and a lower drive shaft supported on respective bearing sets between each leg of the pair of spaced legs;

a plurality of interconnected step assemblies disposed between the pair of spaced legs, wherein each interconnected step assembly of the plurality of interconnected step assemblies comprise a tread, a riser, and an interconnecting plate;

a flywheel drive shaft and support bearing assembly disposed on and extending between the pair of spaced legs in spaced relation to the upper drive shaft, a weighted flywheel disposed on a first end of the flywheel drive shaft and a flywheel pulley disposed on an opposite end of the flywheel drive shaft;

a drive belt in communication with the flywheel pulley; and a drive belt engagement tensioner assembly on the upper drive shaft.

2. The stair step device of claim 1, wherein the tread and riser are connected with the interconnecting plate for each interconnected step assembly.

3. The stair step device of claim 1, further comprising a pair of upstanding handrails with an interconnected support rail.

4. The stair step device of claim 3, further comprising a pair of magnetic resistant brake assemblies positionally engageable with the weighted flywheel for selective activation via control input levers disposed on the pair of upstanding handrails.

5. The stair step device of claim 4, wherein the pair of magnetic resistant brake assemblies comprise the control input levers, and the control input levers are in electronic communication with an electronic informational control display on the interconnected support rail.

6. The stair step device of claim 4, wherein the control input levers provide for user weight input and a desired resistant level.

7. The stair step device of claim 1, further comprising a safety brake having a direct engagement with the weighted flywheel.

8. The stair step device of claim 1, further comprising:

a pair of upper chain engagement sprockets on opposite ends of the upper drive shaft; and a pair of lower chain engagement sprockets on opposite ends of the lower drive shaft.

9. The stair step device of claim 1, further comprising:

a pair of step drive chains, each step drive chain extending around an upper chain engagement sprocket of the pair of upper chain engagement sprockets and a lower chain engagement sprocket of the pair of lower chain engagement sprockets on respective opposing sides of the upper drive shaft and the lower drive shaft.

10. The stair step device of claim 9, wherein the plurality of interconnected step assemblies disposed between the pair of spaced legs are connected between each step drive chain of the pair of step drive chains.

11. A system comprising:

a frame having a pair of spaced legs;

an upper drive shaft and a lower drive shaft supported on respective bearing sets between each leg of the pair of spaced legs;

a set of respective sprockets on opposite ends of the upper drive shaft and opposite ends of the lower drive shaft;

a plurality of interconnected step assemblies disposed between the pair of spaced legs, wherein each interconnected step assembly of the plurality of interconnected step assemblies comprise a tread, a riser, and an interconnecting plate;

a flywheel drive shaft and support bearing assembly disposed on and extending between the pair of spaced legs in spaced relation to the upper drive shaft, a weighted flywheel disposed on a first end of the flywheel drive shaft and a flywheel pulley disposed on an opposite end of the flywheel drive shaft;

a drive belt in communication with the flywheel pulley; and a drive belt engagement tensioner assembly on the upper drive shaft.

12. The system of claim 11, wherein the tread and riser are connected with the interconnecting plate for each interconnected step assembly.

13. The system of claim 11, further comprising a pair of upstanding handrails with an interconnected support rail.

14. The system of claim 13, further comprising a pair of magnetic resistant brake assemblies positionally engageable with the weighted flywheel for selective activation via control input levers disposed on the pair of upstanding handrails.

15. The system of claim 14, wherein the pair of magnetic resistant brake assemblies comprise the control input levers, and the control input levers are in electronic communication with an electronic informational control display on the interconnected support rail.

16. The system of claim 14, wherein the control input levers provide for user weight input and a desired resistant level.

17. The system of claim 11, further comprising a safety brake having a direct engagement with the weighted flywheel.

* * * * *